US005445115A

United States Patent [19]

Murata et al.

[11] Patent Number: 5,445,115

[45] Date of Patent: Aug. 29, 1995

[54] VALVE SYSTEM FOR INTERNAL COMBUSTION ENGINE

[75] Inventors: Shinichi Murata; Noriyuki Miyamura, both of Kyoto, Japan

[73] Assignee: Mitsubishi Jidosha Kogyo Kabushiki Kaisha, Tokyo, Japan

[21] Appl. No.: 166,362

[22] Filed: Dec. 14, 1993

[30] Foreign Application Priority Data

Dec. 16, 1992 [JP] Japan ..... 4-336416
Dec. 7, 1993 [JP] Japan ..... 5-306652

[51] Int. Cl.[6] ..... F01L 1/18; F01L 13/00

[52] U.S. Cl. ..... 123/90.16; 123/90.65; 123/90.17

[58] Field of Search ..... 123/90.15, 90.16, 90.17, 123/90.27, 90.39, 90.4, 90.65, 90.66, 90.67

[56] References Cited

U.S. PATENT DOCUMENTS 1,005,897 10/1911 Shields et al. ..... 123/90.67
1,640,118 8/1927 Ford ..... 123/90.67
1,789,209 1/1931 Asbury ..... 123/90.67
4,788,946 12/1988 Inoue et al. ..... 123/90.4
4,869,214 9/1989 Inoue et al. ..... 123/90.4
5,099,806 3/1992 Murata et al. ..... 123/90.16
5,297,505 3/1994 Doll et al. ..... 123/90.16

FOREIGN PATENT DOCUMENTS 60-38107 3/1985 Japan .
60-88011 6/1985 Japan .

*Primary Examiner*—Henry C. Yuen
*Assistant Examiner*—Weilun Lo

[57] ABSTRACT

A valve system is provided for driving engine valves arranged in an internal combustion engine. The valve system comprises a valve drive arm member pivotally supported on a side of a main body of an engine while being maintained in contact with end portions of the engine valves, a first rocker arm for rocking the valve drive arm member, a second rocker arm for causing the valve drive arm member to undergo rocking at an amplitude greater than rocking by the first rocker arm, and coil springs for urging the engine valves in closing directions, respectively. Each coil spring is interposed between a retainer disposed fixedly on the corresponding engine valve and a cylinder head. Each coil spring is designed to avoid interference with a rocking path of the corresponding rocker arm on a side of the coil spring.

27 Claims, 11 Drawing Sheets

VALVE SYSTEM FOR INTERNAL COMBUSTION ENGINE

BACKGROUND OF THE INVENTION a) Field of the Invention

This invention relates to a valve system for an internal combustion engine, which valve system is suited for use in an automobile engine or the like of the type that engine valves, namely, intake and/or exhaust valves are designed variable in opening/closing timing and valve lift.

b) Description of Background Art

Mechanisms provided with plural kinds of cams of different profiles have been provided to date so that the valve timing and valve lift of each of intake and exhaust valves can be changed in an OHC (overhead camshaft) engine.

These mechanisms are constructed to obtain a valve opening/closing timing conforming with the state of operation of an engine, for example, by providing a camshaft with a high-speed cam and a low-speed cam and selectively achieving valve-driving states according to the profiles of the respective cams.

For example, FIGS. 3 to 7 illustrate a selection mechanism for a high-speed cam and a low-speed cam in such a mechanism. The selection mechanism is constructed as will be described next.

Interposed between cams 102,103,202 and valves 101,101 are rocker arms 104,105,204.

The cams 102,103,202 are constructed as shown in FIGS. 6 and 7. The cams 102,202 have a cam profile as low-speed cams, while the cam 103 has a cam profile as a high-speed cam.

In other words, the high-speed cam 103 is constructed to obtain a cam lift greater than the low-speed cams 102,202.

On the other hand, the rocker arms 104,105,204 are pivotally supported on a rocker shaft 106 and undergo rocking motion about the rocker shaft 106 in accordance with cam lifts by the cams 102,103,202.

Connection and disconnection between the low-speed rocker arms 104,204 and the high-speed rocker arm 105 are effected by pistons 107,108 and a stopper 109.

When working oil is fed to a side of a rear end of the piston 107 through oil passages **106*a*,204*b* in the state depicted in FIG. 4, the pistons 107,108 are driven leftwards in cylinders 204*a*,105*a*,104*a* as shown in FIG. 5 so that the low-speed rocker arms 104,204 and the high-sped rocker arm 105 are connected via the pistons 107,108**.

When operation is carried out in this state, the low-speed rocker arms 104,204 and the high-speed rocker arm 105 both undergo large rocking according to the cam profile of the high-speed cam 103 having the greater cam lift.

As a consequence, the valves 101,101 are opened and closed at a valve timing defined by the high-speed cam.

When the pistons 107,108 are driven rightwards by a return spring 110 to the positions shown in FIG. 4, on the other hand, the low-speed rocker arms 104,204 are no longer in engagement with the high-speed rocker arm 105 and hence undergo small rocking according to the cam profile of the low-speed cams 102,202 having the smaller cam lift.

As a result, the valves 101,101 are opened and closed at a valve timing defined by the low-speed cams 102,202.

Each valve 101 is urged in a closing direction by a coil spring 33 via a valve stem 31 and a retainer 32. The retainer 32 and the coil spring 33 are arranged to avoid interference with the high-speed rocker arm 105 even when they assume highest positions.

Since the high-speed rocker arm 105 is undergoing large rocking for a high speed even when the low-speed rocker arms 104,204 are rocking at a small amplitude for a low speed, there is the potential problem that a rocking end portion of the high-speed rocker arm 105 may interfere with the coil springs 33. It is therefore constructed to avoid such interference by positioning an upper end of each coil spring 33 at a location the way down by a predetermined distance from an upper end of the valve stem 31.

Incidentally, a return spring 111 is mounted on a main body of an engine so that the high-speed rocker arm 105 is urged upwards and is maintained in contact with the high-speed cam 103.

As a valve system equipped with high-speed and low-speed cams so that valve driving states according to the profiles of the respective cams can be selectively attained to obtain a valve opening/closing timing in conformity with the state of operation of an engine, a construction such as that illustrated in FIGS. 8(A) to 12 can also be considered with a view to providing valve-operating characteristics improved over those of the above-described valve system.

Intake or exhaust valves 2,3 arranged in a pair are driven by a cam 12 or 13 by way of a main rocker arm 24 and subrocker arms 26,15.

In the illustrated example, the subrocker arms 26,15 are provided with a low-speed roller 18 and high-speed roller 19 which are maintained in contact with the cams 12,13, respectively, whereby the subrockers 26,15 receive drive force through these rollers 18,19. The low-speed roller 18 and high-speed roller 19 are rotatably supported via bearings 18B,19B on shafts 18A,19A attached to the subrocker arms 26,15, respectively.

The cam 12 is provided with a cam profile for low-speed valve timing like the above-described cams 102,202 while the cam 13 is equipped with a cam profile for high-speed valve timing like the above-described cam 1031 (see FIGS. 6 and 7).

The main rocker arm 24 is pivotally supported on a cylinder head 1 via a rocker shaft 16. Further, proximal end portions of the subrocker arm 26,15 are loosely fitted in the main rocker arm 24. Interposed between the main rocker arm 24 and the subrocker arms 26,15 are hydraulic piston mechanisms 27,17 as mode change-over means.

The hydraulic piston mechanisms 27,17 are constructed in such a way that, upon feeding of a predetermined hydraulic pressure, either a piston 17A or a piston 27A is caused to project from the main rocker arm 24 into the corresponding subrocker arm 15 or 26.

The projecting piston 17A or 27A then engages the corresponding subrocker arm 15 or 26 so that the subrocker arm 15 or 26 is associated with the main rocker arm 24 via the piston 17A or 27A so engaged. The main rocker arm 24 can hence be driven by the cam 13 or 12 which has been brought into engagement with the subrocker arm 15 or 26.

In the above example, as illustrated in FIGS. 8(A) to 12, the pistons 17A,27A in the hydraulic piston mechanisms 17,27 are accommodated within bores 17C,27C formed in the rocker shaft 16 and are urged by springs 17B,27B in predetermined directions, respectively. Described specifically, the piston 17A of the hydraulic piston mechanism 17 is urged in the direction that the subrocker arm 15 does not engage the main rocker arm 24 (i.e., downwards as viewed in FIG. 9), while the piston 27A of the hydraulic piston mechanism 27 is urged in the direction that the subrocker arm 26 engages the main rocker arm 24 (i.e., upwards as viewed in FIG. 10). Oil compartments 17G,27G are arranged to produce hydraulic pressures in opposition to these urging forces, respectively. The hydraulic piston mechanism 17 remains in a non-engaged position as long as no hydraulic pressure is fed to the oil compartment 17G. As soon as the oil compartment 17G is fed with a hydraulic pressure, the hydraulic piston mechanism 17 is brought into an engaged position. The hydraulic piston mechanism 27 remains in an engaged position as long as no hydraulic pressure is fed to the oil compartment 27G. As soon as the oil compartment 27G is fed with a hydraulic pressure, the hydraulic piston mechanism 27 is brought into a non-engaged position.

Formed in communication with the bores 17C,27C are oil holes 17D,27D for feeding lubeoil to the low-speed roller 18 and the high-speed roller 19, respectively. Further, openings of the holes 17C,27C are closed by caps 17E,27E, respectively.

By changing over the hydraulic piston mechanisms 17,27 as described above, either the cam profile of the cam 12 for low-speed valve timing or the cam profile of the cam 13 for high-speed valve timing is selected to achieve a desired valve timing in correspondence to the state of operation of the engine.

The rocker shaft 16 is pivotally supported on bearing portions 1A (see FIG. 8(B)). An oil passage 16A is formed inside the rocker shaft 16.

Also arranged is a lost motion mechanism 20 which pushes a lever portion 15C of the subrocker arm 15. The lost motion mechanism 20 is provided with an outer casing 20A and an inner casing 20B which can advance or retreat in an axial direction relative to the outer casing 20A. By a spring 20C accommodated in a space 20E between both the casings 20A and 20B, the inner casing 20B is urged to project downwardly. The outer casing 20A is fixedly connected to a lost motion holder 1B. A free end portion of the inner casing 20B, which is urged to project as described above, is provided with a contact portion 20D maintained in contact with the lever portion 15C of the subrocker arm 15.

Such a valve system is however accompanied by such problems as will be described next.

The valves 2,3 are each urged in a closing directions by an associated coil spring 4, whose outer shape is cylindrical, via a corresponding valve stem 2A or 3A and a retainer 5. It is therefore necessary to provide the retainer 5 and coil spring 4 in such a way that they do not interfere with the corresponding subrocker arm 26 or 15 even when they assume highest positions.

In the above valve system, the valves 3,2 can be made inoperative or can be allowed to rest by bringing each of the hydraulic piston mechanisms 17,27 into the non-engaged position. Despite the valves 3,2 not moving in such a mode, the subrocker arms 15,26 are continuously driven by the cams 13,12, resulting in the potential problem that, as shown by way of example in FIG. 12, the subrocker arm 15 may interfere with the coil spring 4 and/or the retainer 5. Although not illustrated in any figure, there is also the potential problem that the subrocker arm 26 may interfere with the coil spring 4 and/or the retainer 5. With respect to each of the valves 3,2, it is therefore necessary, as shown in FIG. 11, to design the valve stem 3A in such a way that a sufficient distance (see the dimension A shown in FIG. 11) can be left between an upper end of the coil spring 4 and an upper end of the valve stem 3A.

In particular, there is the high potential problem that a rocking end portion 15A of the high-speed subrocker arm 15 may interfere with the coil spring 4 of the valve 3 because the high-speed subrocker arm 15 is undergoing large rocking for a high speed. The upper end of the coil spring 4 is therefore positioned at a point substantially lower than the upper end of the valve stem 3A, whereby the potential problem of interference can be avoided.

Even when the valves are not made inoperative, there is the possibility that the high-speed subrocker arm 15 undergoes large rocking for a high speed by the cam 13 while the valve 3 is reciprocated at a small stroke for a low speed. In this case, there is also the potential problem that the subrocker arm 15 may interfere with the coil spring 4 and/or the retainer 5. It is hence necessary to leave the distance A as much as needed between the upper end of the coil spring 4 and the upper end of the valve stem 3A.

Further, the high-speed subrocker arm 15 may jump off from the high-speed cam 13 during high-speed operation. Even in such a case, it is also necessary to ensure the avoidance of interference between the rocking end portion 15A of the high-speed subrocker arm 15 and the coil spring 4.

As has been described above, it is necessary for each of the valve stems 2A,3A to have a sufficient distance A (see FIG. 11) between the upper end of the coil spring 4 and the upper end of the valve stem. Especially where there is the high-speed rocker arm 15, it is necessary to increase the dimension A compared with a construction in which the high-speed rocker arm 15 is not provided. This leads to an increase in the overall height of the valve system. As a result, the overall height (the dimension C shown in FIG. 11) of the valve system becomes greater, leading eventually to an engine having a larger height or width. Although it is basically desired to promote the dimensional reduction of engines, use of such a valve system conversely increases the engine dimensions.

Such a problem similarly arises on the first-mentioned conventional valve system.

First, in the structure of the conventional valve system shown in FIGS. 3 to 6, the high-speed rocker arm 105 is undergoing large rocking for a high speed even when the low-speed rocker arms 104,204 are rocking at a small amplitude for a low speed. There is accordingly the potential problem that the rocking end portion of the high-speed rocker arm 105 may interfere with the coil springs 33. It is therefore necessary to extend the end portions of the valve stems 31 by a predetermined length so that the valve system is disposed above the upper end of the coil spring 33 to avoid the interference.

Accordingly, it is necessary to leave a sufficient distance (see the distance A shown in FIG. 11) between the upper end of each valve stem 31 and the upper end of the associated coil spring 33. Especially where there is the high-speed rocker arm 105, it is necessary to increase the dimension A compared with a construction in which the high-speed rocker arm 105 is not provided.

This leads to an increase in the overall height (see the dimension C depicted in FIG. 11) of the valve system.

This unavoidably leads to an engine having a greater overall height, resulting in problems such that the freedom of vehicle mountability is lowered, the weight of the engine assembly is increased, and the moving performance of a vehicle is deteriorated.

To avoid the interference, one could consider reducing the overall length of each coil spring 33. Such a reduced overall length however requires an additional measure for ensuring production of predetermined urging force. The freedom of design is hence lowered and modifications may become necessary in the whole engine design. Use of such shorter coil springs is therefore not preferred from the standpoints of cost, engine performance and the like.

As has been described above, a valve system in which the motion of rocker means for driving valves may become greater than the motion of the valves requires a consideration so that interference between the side of the valves and the side of the rocker means can be prevented. This requirement therefore leads to the problem that the freedom of vehicle mountability is lowered, the weight of the engine assembly is increased, and the moving performance of a vehicle is deteriorated.

Techniques making use of valve springs in a tapered or barrel-shaped form as viewed in cross-sections taken along their axial center lines are disclosed, for example, in Japanese Utility Model Application Laid-Open (Kokai) No. SHO 60-38107 and Japanese Utility Model Application Laid-Open (Kokai) No. SHO 60-88011. These conventional techniques are however intended to reduce the inertial mass and dimensions by making the springs smaller. They do not contain any disclosure about so-called free rocker arms which do not directly drive intake or exhaust valves. The techniques therefore do not teach anything about the interference between the free rocker arms and the springs.

For reducing the overall height of the valve system, it is desired to achieve the avoidance of interference between the low-speed subrocker arm 26 and the coil spring 4 while allowing the coil spring 4 to extend into the range of rocking motion of the low-speed subrocker arm 26.

SUMMARY OF THE INVENTION

With the foregoing in view, the present invention has as a primary object the provision of a valve system for an internal combustion engine, which valve system can retain sufficient urging force for valve stems and can prevent interference between coil springs and rocking portions while reducing the overall height or width of the valve system.

In one aspect of the present invention, there is thus provided a valve system for driving engine valves arranged in an internal combustion engine, comprising:

a valve drive arm member pivotally supported on a side of a main body of an engine while being maintained in contact with end portions of said engine valves;

first rocker means for rocking said valve drive arm member;

second rocker means for causing said valve drive arm member to undergo rocking at an amplitude greater than rocking by said first rocker means; and means for urging said engine valves in closing directions, said urging means being interposed between retainers disposed fixedly on said engine valves and a cylinder head, respectively;

wherein said urging means is provided with interference avoiding means, respectively, so that said urging means keeps out of rocking paths of said first and second rocker means on a side of said urging means.

In another aspect of the present invention, there is also provided a valve system for driving engine valves arranged in an internal combustion engine, comprising:

a valve drive arm member having rocking end portions, which extend in a bifurcated form to contact said engine valves, respectively, and a rocker shaft portion pivotally supported on a side of a main body of an engine;

first rocker means for rocking said valve drive arm member, said first rocker arm being pivotally supported on said rocker shaft portion;

second rocker means for causing said valve drive arm member to undergo rocking at an amplitude greater than rocking by said first rocker means, said second rocker means being pivotally supported on said rocker shaft portion; and means for urging said engine valves in closing directions, said urging means being interposed between retainers disposed fixedly on said engine valves and a cylinder head, respectively;

wherein said urging means is provided with interference avoiding means, respectively, so that said urging means keepout of rocking paths of said first and second rocker means on a side of said urging means.

Despite their simple construction of each valve system according to the present invention, the following advantages can be brought about:

(1) The height and width of the valve system can be kept as small as those of a valve system for a general engine which does not require plural kinds of rocking means.

(2) Owing to the above advantage (1), the freedom of mountability upon construction of a variable valve system by plural kinds of rocking means can be improved and the engine weight can also be reduced. It is hence possible to improve the moving performance of a vehicle.

(3) It has become possible to construct a variable valve system while making the weight of the valve system lighter compared with a construction equipped with a conventional variable valve system. This has made it possible to provide a valve system with improved dynamic characteristics and also an engine with improved performance.

(4) Even if a rocking end portion of a drive arm or rocking means jumps off from an associated cam during high-speed operation, it is still possible to avoid interference between a retainer and/or coil spring and the rocking end portion of the valve drive arm or rocking means.

(5) The freedom of spring design can be improved.

(6) Since the bearing pressure of rollers can be reduced, it is possible to use rollers having a smaller width and thus to achieve a further reduction in the weight of the valve system. As a result, the engine can be operated at greater revolutions to increase the output.

(7) The above advantages (1) to (6) can be obtained without increasing the number of parts.

BRIEF DESCRIPTION OF THE DRAWINGS

The above and other objects, features and advantages of the present invention will become apparent from the following description and the appended claims, taken in conjunction with the accompanying drawings, in which:

DESCRIPTION OF THE PREFERRED EMBODIMENTS

Figure 1:
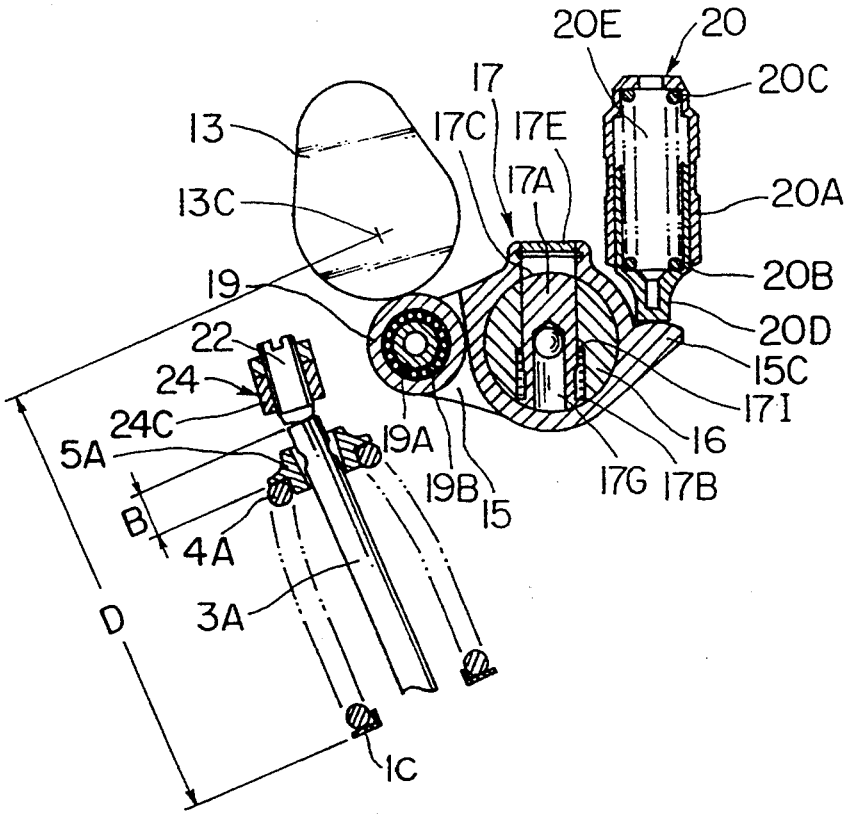
FIG. 1 is a schematic fragmentary vertical cross-sectional view of a valve system according to one embodiment of the present invention [which corresponds to a cross-sectional view taken in the direction of arrows I—I of FIG. 8(B)], in which a valve is in an unlifted position.
Figure 2:
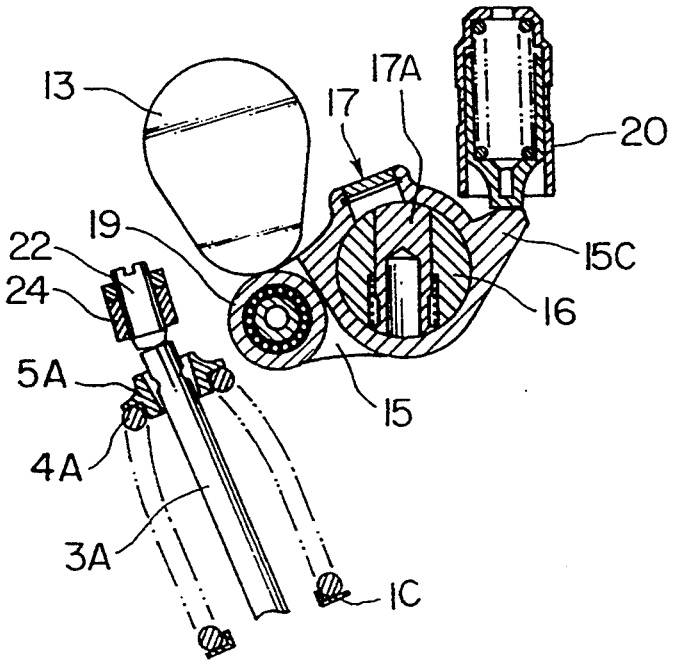
FIG. 2 is a schematic fragmentary vertical cross-sectional view of the valve system according to the one embodiment of the present invention [which corresponds to a cross-sectional view taken in the direction of arrows II—II of FIG. 8(B)], in which the valve is in a lifted position.
Figure 3:
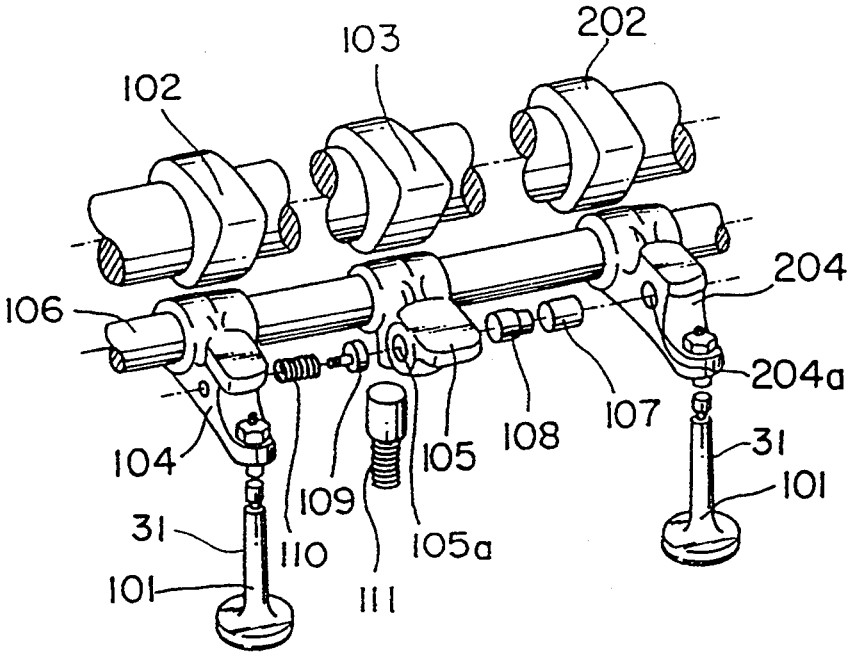
FIG. 3 (PRIOR ART)
FIG. 3 is a schematic perspective view showing one example of a valve system equipped with a conventional variable valve timing mechanism.
Figure 4:
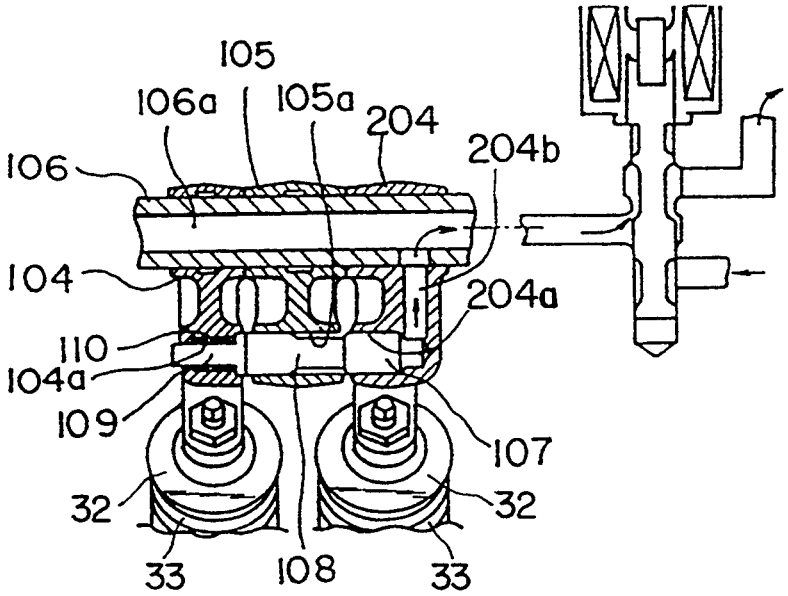
FIG. 4 (PRIOR ART)
FIG. 4 is a schematic cross-sectional view of rocker arm portions, showing operation of the rocker arm portions in the one example of the valve system equipped with the conventional variable valve timing mechanism.
Figure 5:
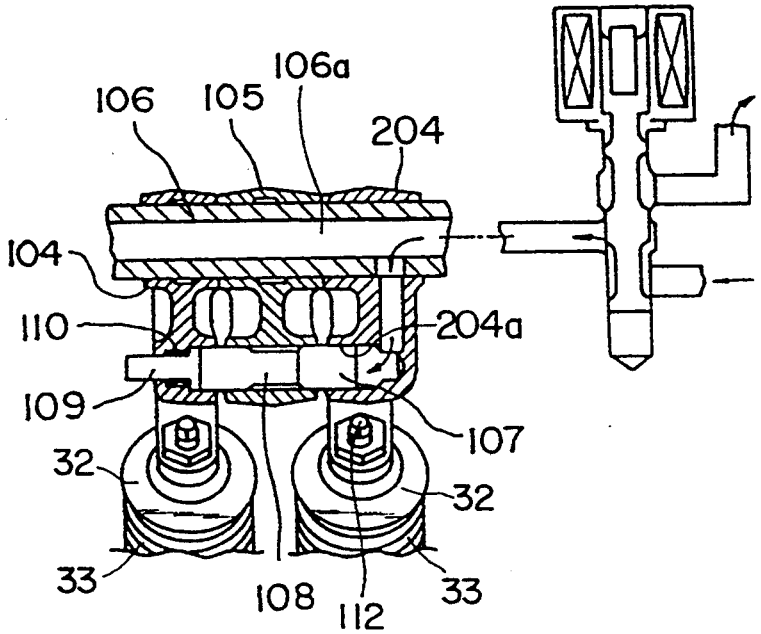
FIG. 5 (PRIOR ART)
FIG. 5 is a schematic cross-sectional view of rocker arm portions, showing operation of the rocker arm portions in the one example of the valve system equipped with the conventional variable valve timing mechanism.

Referring now to FIGS. 1 and 2, the valve system according to the one embodiment of the present invention for the internal combustion engine will hereinafter be described.

Figure 8A:
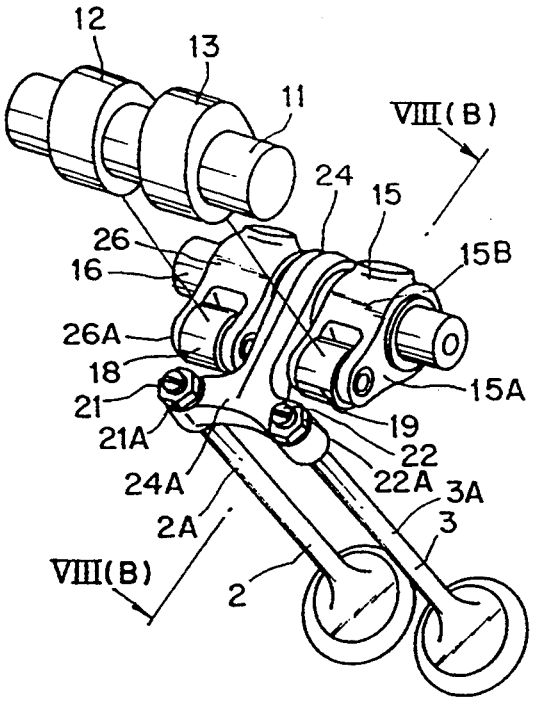
FIG. 8(a) (RELATED ART)
FIG. 8(A) is a schematic fragmentary perspective view of a valve system provided with a variable valve timing mechanism devised in the course of completion of the present invention, in which a cam portion is shown in a form separated from rocker arms.
Figure 8B:
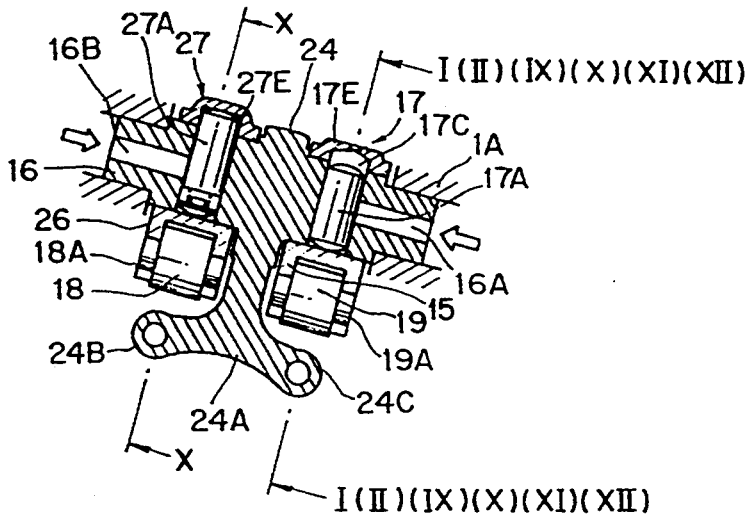
FIG. 8(b) (RELATED ART)
FIG. 8(B) is a cross-sectional view taken in the direction of arrows VIII(B)—VIII(B) of FIG. 8(A)
Figure 9:
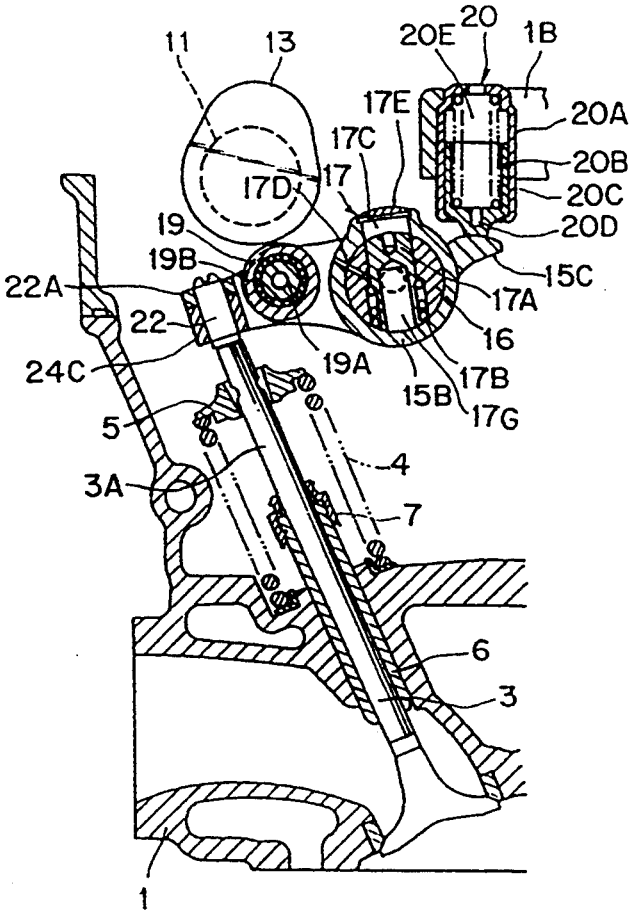
FIG. 9 (RELATED ART)
FIG. 9 is a fragmentary vertical cross-sectional view taken in the direction of arrows IX—IX of FIG. 8(B), which illustrates the valve system provided with the variable valve timing mechanism devised in the course of completion of the present invention.
Figure 10:
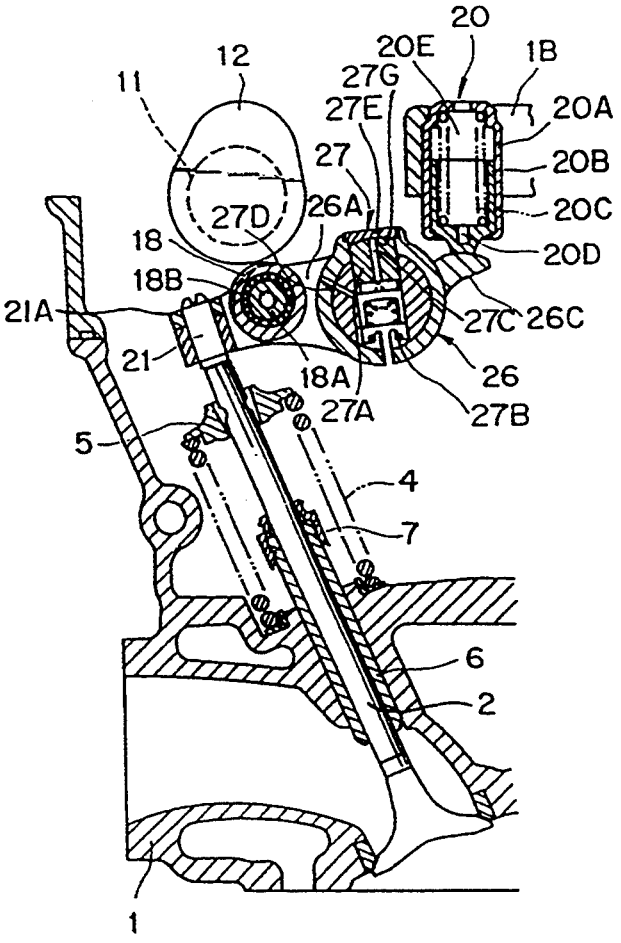
FIG. 10 (RELATED ART)
FIG. 10 is a fragmentary vertical cross-sectional view taken in the direction of arrows X—X of FIG. 8(B), which schematically illustrates the construction of an essential part in the valve system provided with the variable valve timing mechanism devised in the course of completion of the present invention.

A large part of this embodiment is constructed practically in a similar manner to the related example shown in FIGS. 8 to 10. Intake valves 2,3 or exhaust valves arranged in a pair as engine valves are driven by a cam 12 or 13 as first or second rocking means by way of a main rocker arm 24 as a valve drive arm member and subrocker arms 26,15 as first and second rocking means. The main rocker arm 24 is provided with rocking end portions 24A which extend in a bifurcated form to contact both the two engine valves 2,3.

In the illustrated embodiment, the subrocker arms 26,15 are provided with a low-speed roller 18 and high-speed roller 19 which are maintained in contact with the cams 12,13, respectively, whereby the subrockers 26,15 receive drive force through these rollers 18,19. The low-speed roller 18 and high-speed roller 19 are rotatably supported via bearings 18B,19B on shafts 18A,19A attached to the subrocker arms 26,15, respectively.

Figure 6:
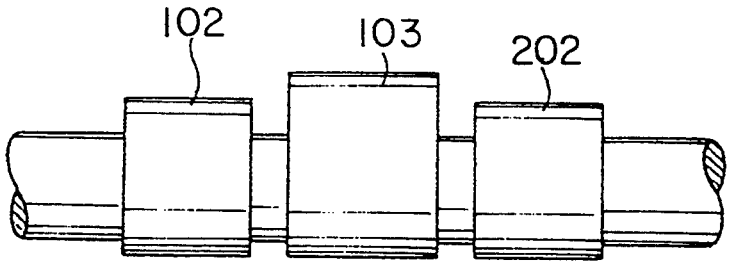
FIG. 6 (PRIOR ART)
FIG. 6 is a side view of a cam portion in each of the valve systems which are equipped with variable valve timing mechanisms according to the present invention and the conventional example, respectively.
Figure 7:
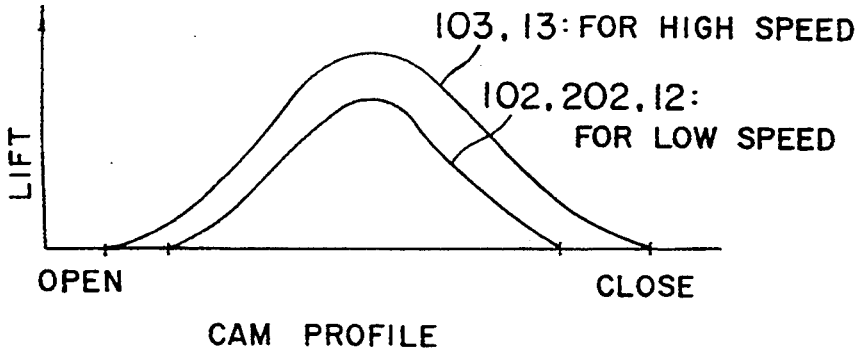
FIG. 7 (PRIOR ART)
FIG. 7 is a diagram showing cam profiles in each of the valve systems which are equipped with variable valve timing mechanisms according to the present invention and the conventional example, respectively.

The cam 12 is provided with a cam profile for low-speed valve timing while the cam 13 is equipped with a cam profile for high-speed valve timing (see FIGS. 6 and 7).

The main rocker arm 24 is pivotally supported on a cylinder head 1 via a rocker shaft 16. Further, proximal end portions of the subrocker arms 26,15 are loosely fitted in the main rocker arm 24. Interposed between the main rocker arm 24 and the subrocker arms 26,15 are hydraulic piston mechanisms 27,17 as mode change-over mechanisms. In particular, the main rocker arm 24 has, in addition to the above-described two rocking end portions 24A, a rocker shaft portion 24D disposed coaxially with the rocker shaft 16 and supported for rotation on a side of a main body of an engine.

The hydraulic piston mechanisms 17,27 are constructed in such a way that, upon feeding of a predetermined hydraulic pressure, either a piston 17A or a piston 27A is caused to project from the main rocker arm 24 into the corresponding subrocker arm 15 or 26.

The projecting piston 17A or 27A then engages the corresponding subrocker arm 15 or 26 so that the subrocker arm 15 or 26 is associated with the main rocker arm 24 via the piston 17A or 27A so engaged. The main rocker arm 24 can hence be driven by the cam 13 or 12 which has been brought into engagement with the subrocker arm 15 or 26.

In the above embodiment, as illustrated in FIGS. 1 and 8(A) to 12, the pistons 17A,27A in the hydraulic piston mechanisms 17,27 are accommodated within bores 17C,27C formed in the rocker shaft 16 and are urged by springs 17B,27B in predetermined directions, respectively. Described specifically, the piston 17A of the hydraulic piston mechanism 17 is urged in the direction that the subrocker arm 15 does not engage the main rocker arm 24 (i.e., downwards as viewed in FIG. 1), while the piston 27A of the hydraulic piston mechanism 27 is urged in the direction that the subrocker arm 26 engages the main rocker arm 24 (i.e., upwards as viewed in FIG. 10). Oil compartments 17G,27G are arranged to produce hydraulic pressures in opposition to these urging forces, respectively. The hydraulic piston mechanism 17 remains in a non-engaged position as long as no hydraulic pressure is fed to the oil compartment 17G. As soon as the oil compartment 17G is fed with a hydraulic pressure, the hydraulic piston mechanism 17 is brought into an engaged position. The hydraulic piston mechanism 27 remains in an engaged position as long as no hydraulic pressure is fed to the oil compartment 27G. As soon as the oil compartment 27G is fed with a hydraulic pressure, the hydraulic piston mechanism 27 is brought into a non-engaged position.

Formed in communication with the bores 17C,27C are oil holes 17D,27D for feeding lubeoil to the low-speed roller 18 and the high-speed roller 19, respectively. Further, openings of the holes 17C,27C are closed by caps 17E,27E, respectively.

By changing over the hydraulic piston mechanisms 17,27 as described above, either the cam profile of the cam 12 for low-speed valve timing or the cam profile of the cam 13 for high-speed valve timing is selected to achieve a desired valve timing in correspondence to the state of operation of the engine.

The rocker shaft 16 is pivotally supported on bearing portions 1A [see FIG. 8(B)]. An oil passage 16A is formed inside the rocker shaft 16.

Also arranged is a lost motion mechanism 20 which pushes a lever portion 15C of the subrocker arm 15. The lost motion mechanism 20 is provided with an outer casing 20A and an inner casing 20B which can advance or retreat in an axial direction relative to the outer casing 20A. By a spring 20C accommodated in a space 20E between both the casings 20A and 20B, the inner casing 20B is urged to project downwardly. The outer casing 20A is fixedly connected to a lost motion holder 1B. A free end portion of the inner casing 20B, which is urged to project as described above, is provided with a contact portion 20D maintained in contact with the lever portion 15C of the subrocker arm 15. By this lost motion mechanism 20, the roller 19 of the subrocker arm 15 is always maintained in contact with the cam 13.

Here, the valve 3 is urged in a closing direction by a coil spring 4A as spring means via a valve stem 3A and a retainer 5A as shown in FIGS. 1 and 2. The retainer 5A and the coil spring 4A are formed in such shapes that their contours are tapered toward the retainer 5A, whereby the tapered shape functions as interference avoiding means. Although not illustrated in any figure, the valve 2 is also urged in a closing direction by its corresponding coil spring 4A via its valve stem 2A and an associated retainer 5A. These retainer 5A and coil spring 4A are also formed in such shapes that their contours are tapered toward the retainer 5A. Here again, the tapered shape functions as interference avoiding means.

Namely, as is illustrated in FIG. 2, the high-speed subrocker arm 15 is normally rocking at a large amplitude for a high speed. There are however situations such that the high-speed subrocker arm 15 is not associated with the main rocker arm 24 but the low-speed subrocker arm 26 (see FIG. 8) and the main rocker arm 24 are associated together to permit reciprocations of the valves 2,3 at a small stroke for a low speed and that, although the high-speed subrocker arm 15 is undergoing large rocking for a high speed and the low-speed subrocker arm 26 is undergoing small rocking for a low speed, the main rocker arm 24 is associated with neither of the subrocker arms 15,26 and the valves 2,3 remain rested. In such situations, there is the high potential problem that the rocking end portions 26A,15A of the low-speed and high-speed subrockers 26,15 may interfere with the coil springs 4A as spring means and/or the retainers 5A.

To avoid this interference, the coil spring 4A is formed in such a shape that its outer contour is tapered toward the side of the retainer 5A. In other words, a portion of the coil spring 4A, said portion being on a side of the retainer 5A, and the retainer 5A are formed with their diameters reduced in view of paths of the rocking end portions 26A,15A of the low-speed subrocker arm 26 and high-speed subrocker arm 15 as rocking ends of drive transmitting members in a valve drive arm member and rocker means.

A rocking end portion of the roller 19 or 18 on the subrocker arm 15 or 26 is allowed to advance and enter an interior of a space formed as a result of the reduction of the diameter of the corresponding coil spring 4A in an outer periphery of the retainer-side end thereof so that a central pivot axis of the rocker arm 15 or 26 is located closer toward a side of the coil spring 4A by a distance of the advance of the roller 19 or 18.

The coil springs 4A are formed so that they extend to end portions of the valve stems 2A,3A.

As shown in FIGS. 1 and 2, a lower end of each coil spring 4A is supported on a spring seat 1C on the side of the cylinder head whereas an upper end of the coil spring 4A is supported by the retainer 5A fixed to the upper end of the valve stem 3A.

Because of the construction described above, the following operation is performed in the present embodiment.

In the valve system, the intake valves 2,3 or exhaust valves arranged in a pair are driven by the cam 12 or 13 via the main rocker arm 24 as a valve drive arm member, the subrocker arm 26 as a low-speed drive transmitting member constituting the first rocker means and the subrocker arm 15 as a high-speed drive transmitting member constituting the second rocker means.

Since the cam 12 is provided with the cam profile for low-speed valve timing and the cam 13 is equipped with the cam profile for high-speed valve timing (see FIGS. 6 and 7), it is possible to achieve either a low-speed drive transmission state in which a cam lift by the low-speed cam 12 is transmitted to the main rocker arm 24 via the subrocker arm 26 or a high-speed drive transmission state in which a cam lift by the high-speed cam 13 is transmitted to the main rocker arm 24 via the subrocker arm 15.

Namely, the main rocker arm 24 is pivotally supported on the cylinder head 1 via the rocker shaft 16 and the proximal end portions of the subrocker arms 26,15 are loosely fitted in the main rocker arm 24. Therefore, the main rocker arm 24 undergoes rocking about a pivot to the cylinder head 1 while the subrocker arms 26,15 undergo rocking about basal end portions of the main rocker arm 24.

Interposed between the main rocker arm 24 and the subrocker arms 26,15 are the hydraulic piston mechanisms 27,17 as the mode change-over mechanisms. When a predetermined hydraulic pressure is fed to the hydraulic piston mechanisms 27,17, either the piston 17A or the piston 27A is caused to project from the main rocker arm 24 into the subrocker arm 26 or 15.

The projecting piston 17A or 27A then engages the corresponding subrocker arm 15 or 26 so that the subrocker arm 15 or 26 is associated with the main rocker arm 24 via the piston 17A or 27A so engaged.

Since the subrocker arms 26,15 are in engagement with the cams 12,13 via the rollers 18,19 mounted on the subrocker arms 26,15, the subrocker arm 26 undergoes low-speed rocking and the subrocker arm 15 undergoes high-speed rocking.

The main rocker arm 24 can hence be driven by the cam 12 or 13 which has been brought into engagement with the subrocker arm 26 or 15.

Rocking of each of the main rocker arm 24, subrocker arms 26,15 and valve stems 2A,3A is effected as described above. During this rocking, interference of the retainers 5A and coil springs 4A with the main rocker arm 24 as the valve drive arm member or with the rocking ends 26A,15A of the rocking means can be avoided.

For example, as shown in FIG. 2 with respect to the high-speed subrocker arm 15 but not illustrated in any figure with respect to the low-speed subrocker arm 26, the interference avoiding means for each arm is constructed by forming the outer profile of the corresponding coil spring 4A in a shape tapered toward the corresponding retainer 5A. Further, the retainer 5A and the portion **4*a* of the coil spring 4A, said portion 4*a* being on the side of the retainer 5A, are formed with their diameters reduced in view of the paths of the main rocker arm 24 and the rocking ends 26A,15A. It is therefore possible to avoid interference of the retainers 5A and coil springs 4A with the main rocker arm 24 as the valve drive arm member or with the rocking ends 26A,15A** of the rocking means.

Further, the coil springs 4A extend to the end portions of the valve stems 2A,3A so that the urging of the valve stems 2A,3A by the coil springs 4A can be effected sufficiently.

In the manner described above, either the profile of the cam 12 for low-speed valve timing or the profile of the cam 13 for high-speed valve timing can be selected, thereby making it possible to achieve a desired valve timing in correspondence to the state of operation of the engine.

Figure 11:
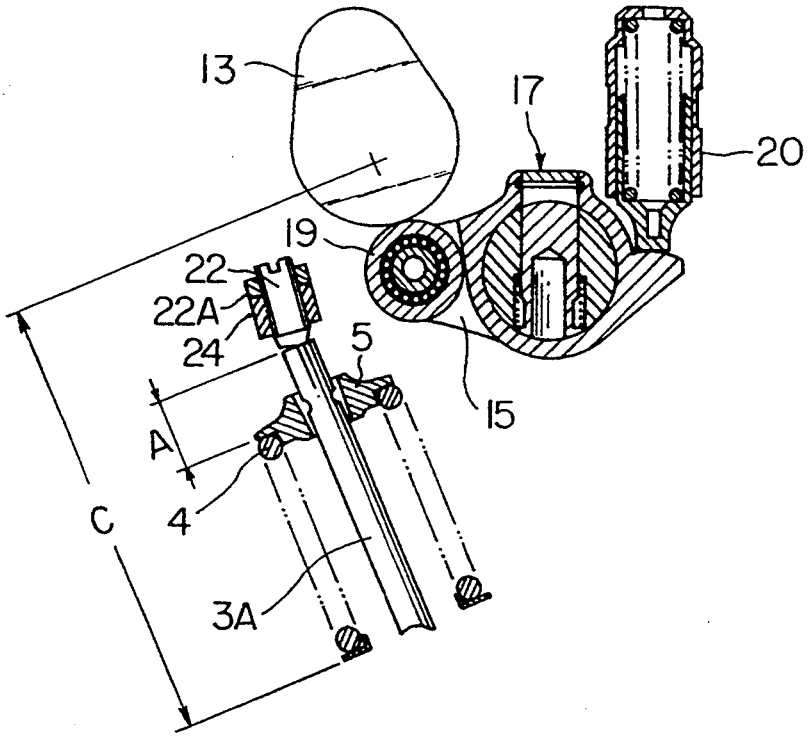
FIG. 11 (RELATED ART)
FIG. 11 is a fragmentary vertical cross-sectional view taken in the direction of arrows XI—XI of FIG. 8(B), which schematically illustrates the state of operation of an essential part in the valve system provided with the variable valve timing mechanism devised in the course of completion of the present invention and shows a valve in an unlifted position.
Figure 12:
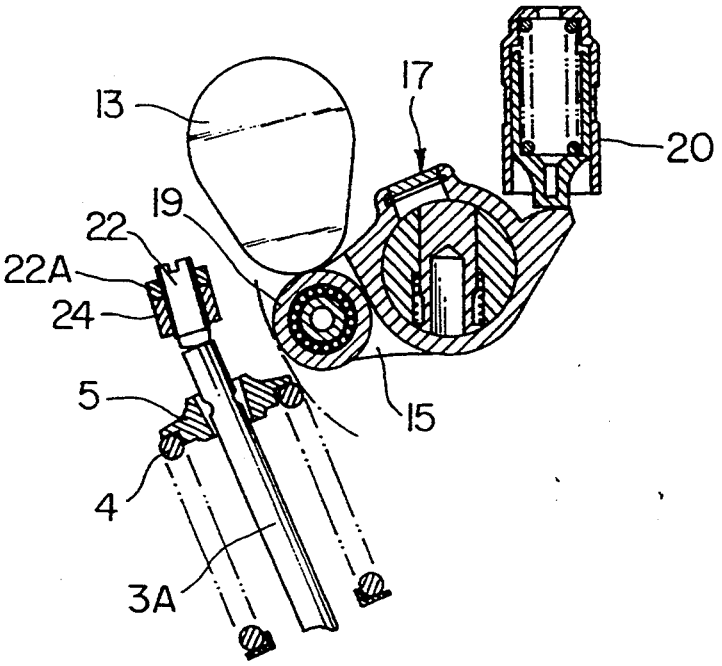
FIG. 12 (RELATED ART)
FIG. 12 is a fragmentary vertical cross-sectional view taken in the direction of arrows XII—XII of FIG. 8(B), which schematically illustrates the state of operation of an essential part in the valve system provided with the variable valve timing mechanism devised in the course of completion of the present invention and shows a valve in a lifted position.

The distance from the upper end of each coil spring 4A to the upper end of the corresponding valve stem 3A (see the dimension B shown in FIG. 1) can therefore be set shorter than that in the related structure (see the dimension A depicted in FIG. 11). As a result, the height of the valve system from a center 13C of the cam shaft 13 to the spring seat 1C (see the dimension D shown in FIG. 1) can be set lower than that in the related structure (see the dimension C shown in FIG. 11).

In the manner described above, it is possible to reduce the overall height or overall width of a valve system while making it possible to retain sufficient urging force for the valve stems and also to surely prevent interference between coil springs and rocking portions. This can bring about merits such that the overall height or width of an engine can be reduced, the freedom of vehicle mountability can be improved, the weight of an engine assembly can be lowered, and the moving performance of a vehicle can be improved.

Further, the provision of the interference avoiding means with each coil spring 4A allows to set smaller the ratio of the distance between the center of rotation of the main rocker arm 24 (i.e., a central axis of the rocker shaft portion 24D) and a contact portion of the main rocker arm 24, said contact portion being on the side of the drive valves, to the distance between the center of rotation of the main rocker arm 24 (i.e., the central axis of the rocker shaft 24D) and the center of rotation of the associated roller, in other words, makes closer the center of the rocker shaft and the valve stem. Therefore, the overall height or width of the engine can be reduced and, moreover, the rocker ratio (the ratio of the distance between the center of the rocker shaft to the valve stem 3A to the distance between the center of the rocker shaft to the point of contact between the cam 13 and the roller 19) can be set smaller. As a consequence, the roller pressure is lowered so that the roller width can be reduced. The weight of the valve system can be reduced further. As a result, the engine can be operated at greater revolutions, thereby bringing about the advantage that the output can be increased further.

The valve system of this embodiment, which is suited for use in an internal combustion engine, is only required to have interference avoiding means so that each coil spring or retainer has a contour not interfering with the path of rocking motion of the corresponding subrocker arm. The present invention can therefore be applied widely to valve systems insofar as the valve systems can selectively achieve valve driving states in accordance with the cam profiles of a high-speed cam and a low-speed cam and can hence obtain a valve opening/closing timing conforming with an operation state of an engine, led by the valve system described above as prior art (see FIGS. 3 to 6) and, although not illustrated in any figure, for example, including a valve system in which the subrocker arm 26 and the main rocker arm 24 are formed integrally.

The interference avoiding means is not limited, as shown in FIG. 1, to the coil spring 4A having the tapered shape that the coil diameter is gradually reduced only in a part of the coil spring, that is, only in an upper half portion thereof, but coil springs of various shapes can also show similar effects to this embodiment.

Figure 13:
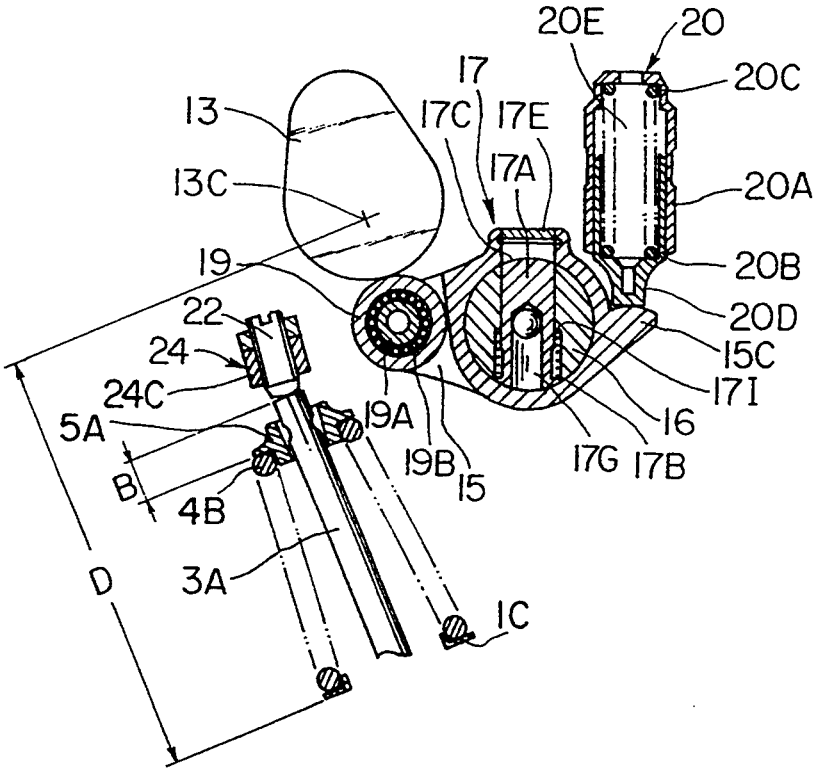
FIG. 13 is a vertical cross-sectional view corresponding to FIG. 1 and schematically showing a first modification of the shape of spring means as interference avoiding means in the valve system according to the one embodiment of the present invention for the internal combustion engine.
Figure 14:
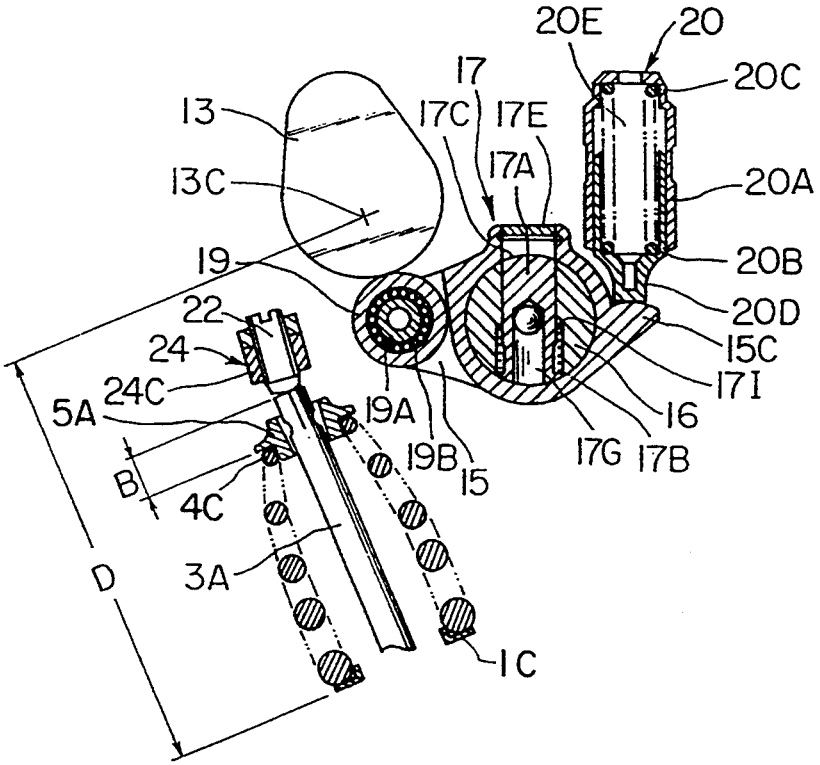
FIG. 14 is a vertical cross-sectional view corresponding to FIG. 1 and schematically showing a second modification of the shape of spring means as interference avoiding means in the valve system according to the one embodiment of the present invention for the internal combustion engine.

As illustrated in FIGS. 13 and 14, for example, it is possible to use a coil spring 4B or 4C of such a tapered shape that its contour is tapered over the entire length thereof from a lower end to an upper end. In the modification shown in FIG. 13, the coil diameter is gradually reduced in a linear pattern toward the upper end so that the contour of the entire coil as viewed in a vertical cross-section taken along a central axis is formed of straight lines. In the coil spring 4C depicted in FIG. 14, the coil diameter is gradually reduced in a non-linear pattern toward the upper end, whereby the contour of the entire coil as viewed in a vertical cross-section taken along a central axis thereof is formed of curves. In the modification shown in FIG. 14, the diameter of the wire of the coil spring 4C gradually becomes smaller from the lower end toward the upper end. The wire of the coil spring 4C may however have a uniform diameter like ordinary spring wires.

Figure 15:
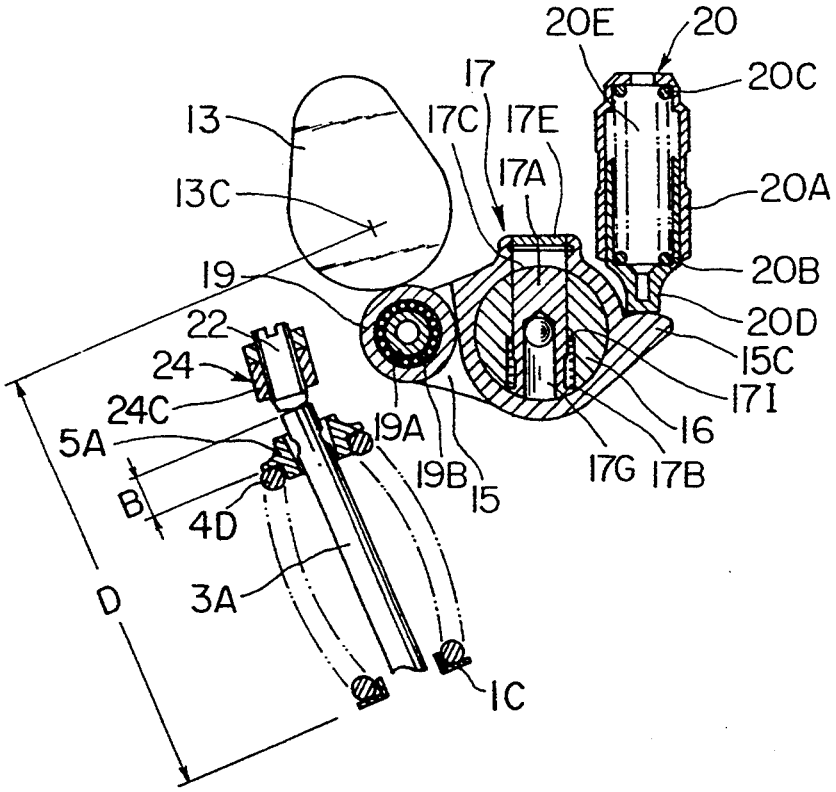
FIG. 15 is a vertical cross-sectional view corresponding to FIG. 1 and schematically showing a third modification of the shape of spring means as interference avoiding means in the valve system according to the one embodiment of the present invention for the internal combustion engine.
Figure 16:
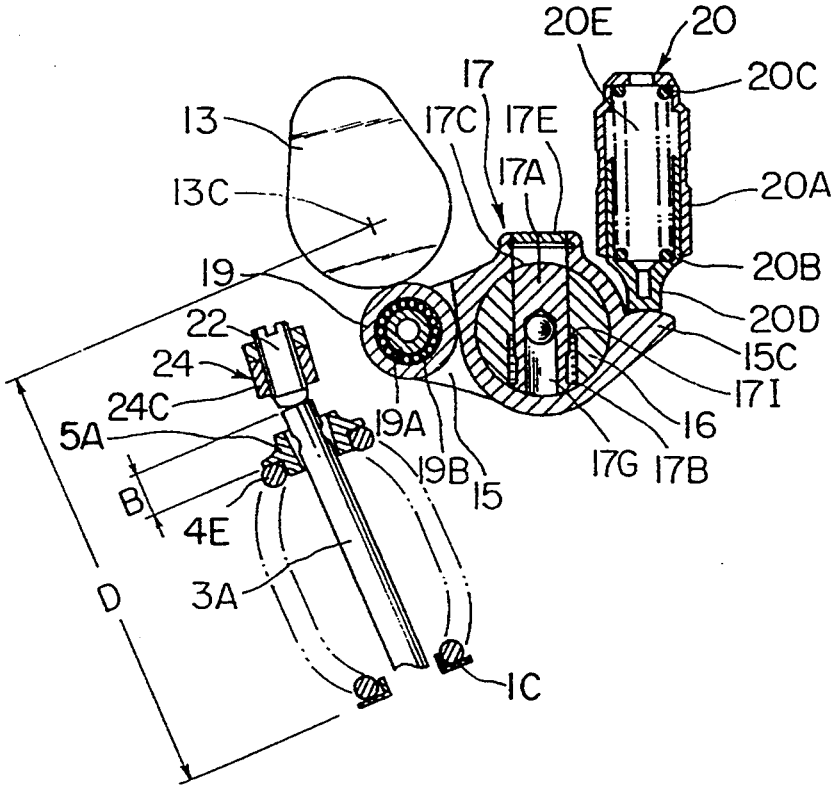
FIG. 16 is a vertical cross-sectional view corresponding to FIG. 1 and schematically showing a fourth modification of the shape of spring means as interference avoiding means in the valve system according to the one embodiment of the present invention for the internal combustion engine.
Figure 17:
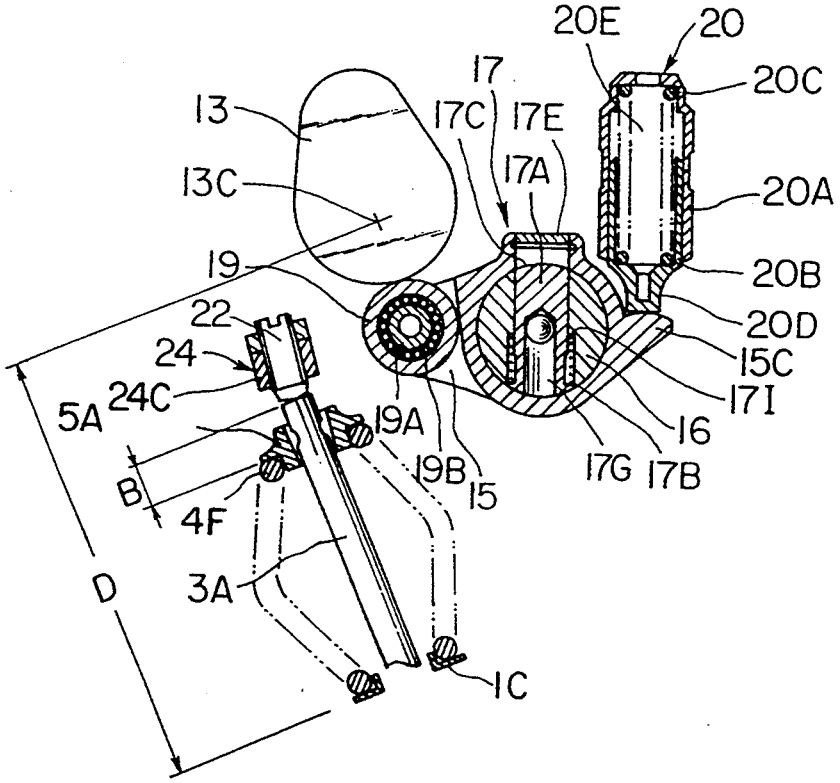
FIG. 17 is a vertical cross-sectional view corresponding to FIG. 1 and schematically showing a fifth modification of the shape of spring means as interference avoiding means in the valve system according to the one embodiment of the present invention for the internal combustion engine.

Further, as shown in FIG. 15, it is also possible to use a coil spring 4D having, as viewed in a vertical cross-section taken along a central axis thereof, such a barrel-shaped contour that the coil diameter is gradually reduced toward both an upper end and a lower end thereof. In the modification shown in FIG. 15, the coil diameter gradually increases from the lower end thereof to an axial midpoint thereof and then gradually decreases from the axial midpoint to the upper end thereof, both in a non-linear pattern, so that its overall contour as viewed in the vertical cross-section taken along the central axis thereof is formed of curves. As a still further modification, it is also possible to use a coil spring 4E in which, as illustrated in FIG. 16, only an intermediate portion is in the form of a cylinder having a uniform coil spring and the coil diameter is gradually reduced to present a tapered shape in the remaining portions, that is, in an upper end portion and a lower end portion thereof. As a still further modification, it is also possible to use a barrel-shaped coil spring 4F in which, as depicted in FIG. 17, the coil diameter gradually increases from a lower end thereof to an axial midpoint thereof and then gradually decreases from the axial midpoint to an upper end thereof, both in a linear pattern.

Figure 18:
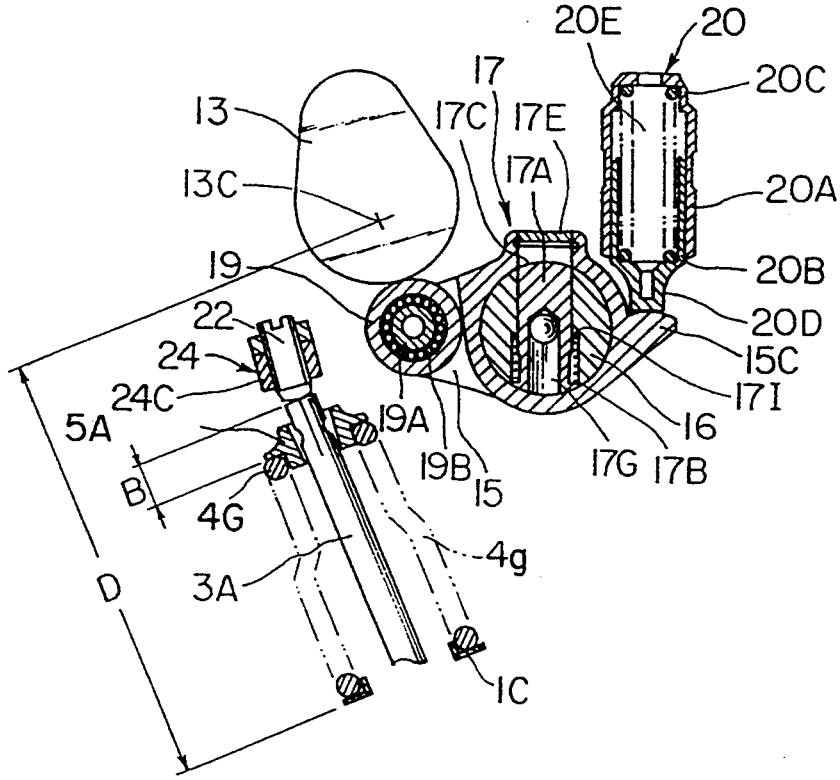
FIG. 18 is a vertical cross-sectional view corresponding to FIG. 1 and schematically showing a sixth modification of the shape of spring means as interference avoiding means in the valve system according to the one embodiment of the present invention for the internal combustion engine.

Further, as shown in FIG. 18, it is also possible to use a stepped coil spring 4G in which the coil diameter of only an upper end portion above a stepped portion **4*g* is reduced. In the modification shown in FIG. 18, the coil diameter of the upper end portion is constant so that the upper end portion is in the form of a cylinder. The coil diameter of the diameter-reduced upper end portion formed above the stepped portion 4*g*** can also be gradually reduced in either a linear or non-linear pattern toward an upper end thereof.

The valve system according to the present invention shall not be construed to be limited to the structures of various parts of the illustrated embodiment. The present invention can be applied to a wide variety of valve systems as long as they produce at least such a situation that a motion of rocking means for driving valves is greater than that of the valves, such as those employed in engines of the variable valve timing type—including, for example, the valve system shown in FIGS. 3 to 5—as well as engines operable with some of valves made inoperative or rested and variable displacement engines. The application of the present invention can increase the freedom of vehicle mountability of a valve system and can also minimize an increase in the weight of an engine assembly, thereby making it possible to improve the moving performance of a vehicle.

We claim:

1. A valve system for driving engine valves arranged in an internal combustion engine, comprising:

a valve drive arm member pivotally supported on a side of a main body of an engine while being maintained in contact with end portions of said engine valves;

first rocker means for rocking said valve drive arm member;

second rocker means for causing said valve drive arm member to undergo rocking at an amplitude greater than rocking by said first rocker means; and means for urging said engine valves in closing directions, said urging means being interposed between retainers disposed fixedly on said engine valves and a cylinder head, respectively;

wherein said urging means is provided with interference avoiding means, respectively, so that said urging means keeps out of rocking paths of said first and second rocker means on a side of said urging means, each said urging means comprising a coil spring provided with the corresponding retainer at one end portion thereof on a side of said first and second rocker means, and each interference avoiding means comprises a construction in which a diameter of said coil spring is reduced at a portion thereof on a side of said retainer.

2. The valve system of claim 1, wherein said retainer has a contour dimension substantially the same as the diameter of the retainer-side portion of said coil spring.

3. The valve system of claim 1, wherein each interference avoiding means comprises a construction in which said portion of said coil spring on the side of said retainer is formed in a tapered profile so that the diameter of said portion of said coil spring is gradually reduced toward the side of said retainer.

4. The valve system of claim 1, wherein each interference avoiding means comprises a construction in which said coil spring is formed in a tapered profile so that the diameter of said coil spring is gradually reduced toward the side of said retainer.

5. The valve system of claim 1, wherein each interference avoiding means comprises a construction in which said coil spring is formed in a barrel-shaped profile so that the diameter of said coil spring is gradually reduced toward opposite ends of said coil spring.

6. The valve system of claim 1, wherein each interference avoiding means comprises a construction in which the diameter of a portion of said coil spring on the side of said retainer is reduced so that said coil spring has a stepped portion.

7. The valve system of claim 1, wherein each of said first rocker means and second rocker means has a contact portion maintained in contact with an associated cam, and said urging means is arranged adjacent the contact portion in a plane containing said contact portion and extending at a right angle relative to a central axis of rocking motion of said rocker means.

8. The valve system of claim 7, wherein each said urging means comprises a coil spring provided with the corresponding retainer at one end portion thereof on a side of said first and second rocker means; each said interference avoiding means comprises a construction in which a diameter of said coil spring is reduced at a portion thereof on a side of said retainer; a roller drivable by a cam is rotatably supported on each rocker arm; and a rocking end portion of said roller on said at least one of said rocker arms is allowed to advance a distance and enter an interior of a space formed as a result of the reduction of the diameter of the corresponding coil spring in an outer periphery of the retainer-side end thereof so that a central pivot axis of said at least one of said rocker arms is located closer toward a side of said coil spring by said distance.

9. The valve system of claim 1, wherein said first rocker means and said valve drive arm member are formed integrally.

10. The valve system of claim 1, further comprising means for preventing association between each of said first and second rocker means and said valve drive arm member to establish a valve resting mode in which said engine valves remain stopped in a closed state.

11. The valve system of claim 1, further comprising means for preventing association between each of said first and second rocker means and said valve drive arm member to establish a cylinder resting mode in which all the engine valves remain stopped in a closed state.

12. A valve system for driving engine valves arranged in an internal combustion engine, comprising:

a valve drive arm member having rocking end portions, which extend in a bifurcated form to contact said engine valves, respectively, and a rocker shaft portion pivotally supported on a side of a main body of an engine;

first rocker means for rocking said valve drive arm member, said first rocker means being pivotally supported on said rocker shaft portion;

second rocker means for causing said valve drive arm member to undergo rocking at an amplitude greater than rocking by said first rocker means, said second rocker means being pivotally supported on said rocker shaft portion; and means for urging said engine valves in closing directions, said urging means being interposed between retainers disposed fixedly on said engine valves and a cylinder head, respectively;

wherein said urging means is provided with interference avoiding means, respectively, so that said urging means keeps out of rocking paths of said first and second rocker means on a side of said urging means, each said urging means comprising a coil spring provided with the corresponding retainer at one end portion thereof on a side of said first and second rocker means, and each interference avoiding means comprises a construction in which a diameter of said coil spring is reduced at a portion thereof on a side of said retainer.

13. The valve system of claim 12, further comprising means for preventing association between each of said first and second rocker means and said valve drive arm member to establish a cylinder resting mode in which all the engine valves remain stopped in a closed state.

14. The valve system of claim 12, wherein said retainer has a contour dimension substantially the same as the diameter of the retainer-side portion of said coil spring.

15. The valve system of claim 12, wherein each interference avoiding means comprises a construction in which said portion of said coil spring on the side of said retainer is formed in a tapered profile so that the diameter of said portion of said coil spring is gradually reduced toward the side of said retainer.

16. The valve system of claim 12, wherein each interference avoiding means comprises a construction in which said coil spring is formed in a tapered profile so that the diameter of said coil spring is gradually reduced toward the side of said retainer.

17. The valve system of claim 12, wherein each interference avoiding means comprises a construction in which said coil spring is formed in a barrel-shaped profile so that the diameter of said coil spring is gradually reduced toward opposite ends of said coil spring.

18. The valve system of claim 12, wherein each interference avoiding means comprises a construction in which the diameter of a portion of said coil spring on the side of said retainer is reduced so that said coil spring has a stepped portion.

19. The valve system of claim 12, wherein each of said first rocker means and second rocker means has a contact portion maintained in contact with an associated cam, and said urging means is arranged adjacent the contact portion in a plane containing said contact portion and extending at a right angle relative to a central axis of rocking motion of said rocker means.

20. The valve system of claim 12, wherein each urging means comprises a coil spring provided with the corresponding retainer at one end portion thereof on a side of said first and second rocker means; each interference avoiding means comprises a construction in which a diameter of said coil spring is reduced at a portion thereof on a side of said retainer; said first rocker means and second rocker means individually have rocker arms; a roller drivable by a cam is rotatably supported on each rocker arm; and a rocking end portion of said roller on at least one of said rocker arms is allowed to advance a distance and enter an interior of a space formed as a result of the reduction of the diameter of the corresponding coil spring in an outer periphery of the retainer-side end thereof so that a central pivot axis of said at least one of said rocker arms is located closer toward a side of said coil spring by said distance.

21. The valve system of claim 12, further comprising means for preventing association between each of said first and second rocker means and said valve drive arm member to establish a valve resting mode in which said engine valves remain stopped in a closed state.

22. A valve method for driving engine valves arranged in an internal combustion engine, comprising the steps of:

supporting a valve drive arm member on a side of a main body of an engine while being maintained in contact with end portions of said engine valves;

rocking said valve drive arm member;

causing said valve drive arm member to undergo rocking at an amplitude greater than rocking by a first rocker means; and urging each of said engine valves in closing directions by urging means, each said urging means being interposed between retainers disposed fixedly on said engine valves and a cylinder head, respectively;

keeping out of rocking paths of said first rocker means and a second rocker means on a side of said urging means, wherein each said urging means comprises a coil spring provided with the corresponding retainer at one end portion thereof on a side of said first and second rocker means; each interference avoiding means comprises a construction in which a diameter of said coil spring is reduced at a portion thereof on a side of said retainer;

each of said first rocker means and said second rocker means has a contact portion maintained in contact with an associated cam, and said urging means is arranged adjacent the contact portion in a plane containing said contact portion and extending at a right angle relative to a central axis of rocking motion of said rocker means, a roller drivable by a cam is rotatably supported on each rocker arm; and a rocking end portion of said roller on said at least one of said rocker arms is allowed to advance a distance and enter an interior of a space formed as a result of the reduction of a diameter of the corresponding coil spring in an outer periphery of the retainer-side end thereof so that a central pivot axis of said at least one of said rocker arms is located closer toward a side of said coil spring by said distance.

23. The valve method of claim 22, further comprising preventing association between each of said first and second rocker means and said valve drive arm member to establish a valve resting mode in which said engine valves remain stopped in a closed state.

24. The valve method of claim 22, further comprising preventing association between each of said first and second rocker means and said valve drive arm member to establish a cylinder resting mode in which all the engine valves remain stopped in a closed state.

25. A valve method for driving engine valves arranged in an internal combustion engine, comprising the steps of:

providing a valve drive arm member with rocking end portions, which extend in a bifurcated form to contact said engine valves, respectively, and also with a rocker shaft portion pivotally supported on a side of a main body of an engine;

rocking said valve drive arm member by first rocker means pivotally supported on said rocker shaft portion;

causing by second rocker means said valve drive arm member to undergo rocking at an amplitude grater than rocking by said first rocker means, said second rocker means being pivotally supported on said rocker shaft portion;

urging said engine valves in closing directions by urging means interposed between retainers disposed fixedly on said engine valves and a cylinder head, respectively; and keeping said urging means out of rocking paths of said first and second rocker means on a side of said urging means, wherein each engine valve is urged by a coil spring provided with the corresponding retainer at one end portion thereof on a side of said first and second rocker means; each interference avoiding means comprises a construction in which a diameter of said coil spring is reduced at a portion thereof on a side of said retainer; said first rocker means and second rocker means individually have rocker arms; a roller drivable by a cam is rotatably supported on each rocker arm; and a rocking end portion of said roller on said at least one of said rocker arms is allowed to advance a distance and enter an interior of a space formed as a result of the reduction of the diameter of the corresponding coil spring in an outer periphery of the retainer-side end thereof so that a central pivot axis of said at least one of said rocker arms is located closer toward a side of said coil spring by said distance.

26. The valve method of claim 25, further comprising preventing association between each of said first and second rocker means and said valve drive arm member to establish a valve resting mode in which said engine valves remain stopped in a closed state.

27. The valve method of claim 25, further comprising preventing association between each of said first and second rocker means and said valve drive arm member to establish a cylinder resting mode in which all the engine valves remain stopped in a closed state.

* * * * *